United States Patent [19]

Hirth

[11] 4,344,594

[45] Aug. 17, 1982

[54] LIFT MECHANISM FOR DENTAL CHAIR

[75] Inventor: Emil Hirth, Malsch, Fed. Rep. of Germany

[73] Assignee: Sybron Corporation, Rochester, N.Y.

[21] Appl. No.: 149,907

[22] Filed: May 15, 1980

[51] Int. Cl.[3] ..... A47C 1/02; A61G 15/00

[52] U.S. Cl. ..... 248/421; 297/330; 297/DIG. 10

[58] Field of Search ..... 248/419, 421, 585, 586, 248/587; 108/145; 297/330, 348, DIG. 10

[56] References Cited

U.S. PATENT DOCUMENTS

| | | | |
|---|---|---|---|
| 2,101,350 | 12/1937 | Simpson et al. | 248/419 |
| 2,170,098 | 8/1939 | Stephenson | 108/145 X |
| 3,685,780 | 8/1972 | Stannebein | 248/587 X |
| 3,796,282 | 3/1974 | Denier et al. | 108/145 X |
| 3,804,460 | 4/1974 | Leffler | 297/330 |
| 3,917,210 | 11/1975 | Miller | 248/419 |
| 4,083,600 | 4/1978 | Hirth | 297/330 X |

FOREIGN PATENT DOCUMENTS

| | | | |
|---|---|---|---|
| 1104245 | 4/1961 | Fed. Rep. of Germany | 248/586 |

*Primary Examiner*—Wm. Carter Reynolds

*Attorney, Agent, or Firm*—Theodore B. Roessel; Roger Aceto

[57] ABSTRACT

A dental chair lift mechanism employing a parallelogram lift has a linkage arrangement which offsets the horizontal component of motion produced by the parallelogram lift so that the seat of the dental chair can be elevated in a substantially straight vertical path.

6 Claims, 2 Drawing Figures

LIFT MECHANISM FOR DENTAL CHAIR

BACKGROUND OF THE INVENTION

The present invention relates generally to lift mechanisms for a dental chair and more particularly to a parallelogram lift having means for reducing the horizontal component of motion produced by the parallelogram lift.

It is preferred in any dental chair that the chair be lifted in a straight vertical path, however, where a parallelogram lifting arrangement is used, the operation of the lift imparts not only a vertical, but also a horizontal component of motion so that the chair can be said to "travel" horizontally as it is raised or lowered. Various methods have been employed in the parallelogram lifts of dental chairs to compensate for this horizontal component of motion. For example, one such arrangement shown in U.S. Pat. No. 3,804,460 employs a double parallelogram linkage so that as the chair is raised, the forward horizontal component of one of the parallelogram linkages is compensated by a rearward horizontal component of motion of the second parallelogram linkage. Another arrangement of a double parallelogram linkage is shown in U.S. Pat. No. 3,807,680. Other chairs employ a motorized system, wherein, a separate drive motor is used to translate the chair with respect to the parallel motion linkage to compensate for any horizontal component of motion.

In the present invention a single link operatively connected to the parallel motion linkage and the seat of the dental chair acts to move the seat counter to the horizontal motion imparted by the parallel motion linkage.

SUMMARY OF THE INVENTION

The present invention may be characterized by the provision of a dental chair having a fixed base, a support frame and a parallel motion linkage connecting the base to the support frame for moving the frame about the base between a low and a high position. Slidably carried by the support frame is a seat plate on which is mounted the seat, backrest, and legrest portions of the dental chair. A single link is pivotally connected at one end to one member of the parallel motion linkage and is pivotally connected at its other end to the sliding rods bearing the seat plate. The length of this connecting link and the disposition of the pivoted ends are such that the link imparts a horizontal component of motion to the sliding seat which is counter to the horizontal component of motion imparted to the support frame by the parallel motion linkage of the lift mechanism.

DESCRIPTION OF THE PREFERRED EMBODIMENTS

Figure 1:
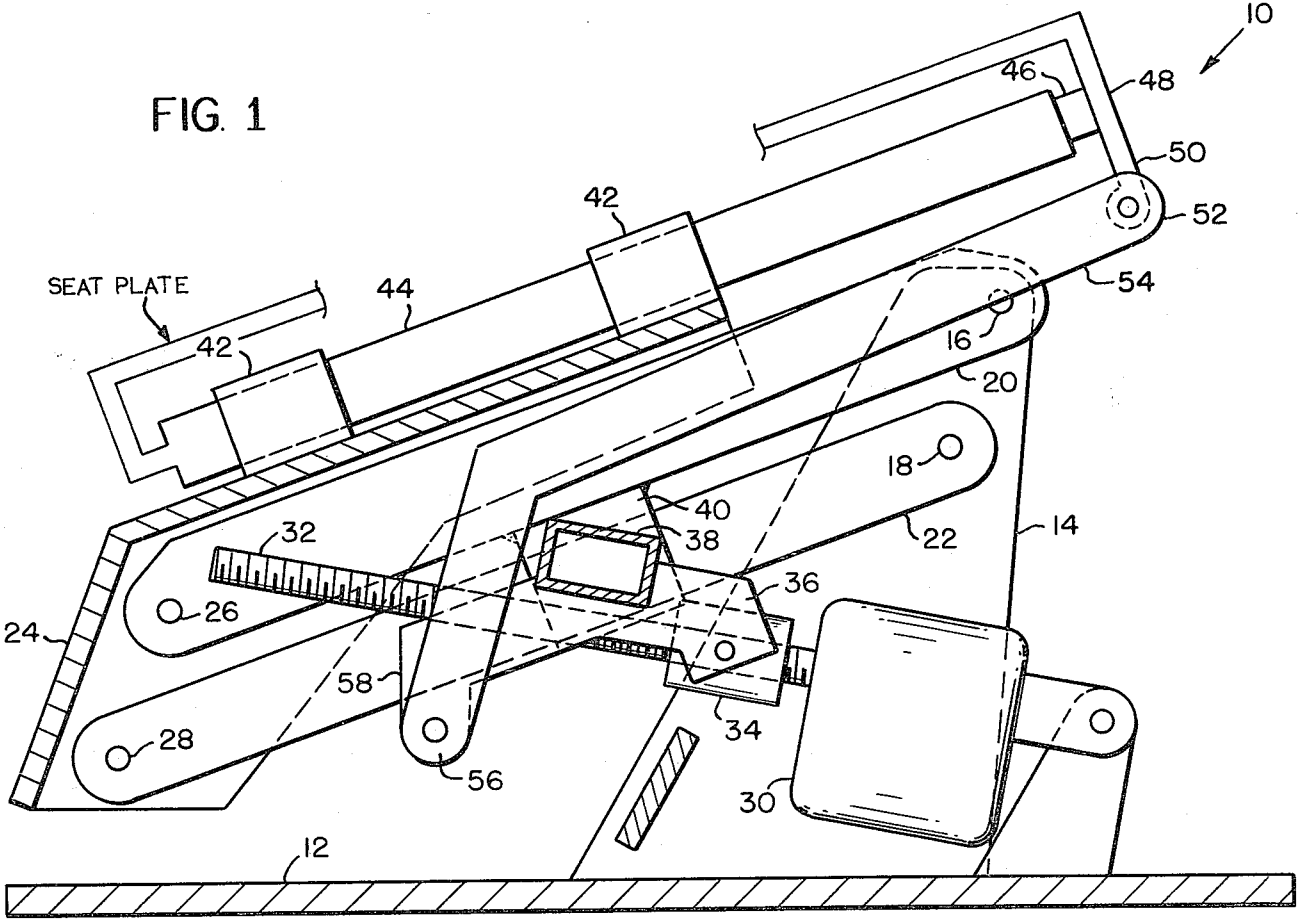
FIG. 1 is a view partly broken away and in section showing the parallelogram lift mechanism of the present invention at its lowest position.

Referring to the drawings, FIG. 1 shows the mechanism of the present invention, generally indicated at 10. This lift includes a conventional base 12 for resting on the floor surface and a member 14 upstanding from the base. Pivoted adjacent the top of member 14 at 16 and 18 are parallelogram members 20, 22. The other ends of members 20, 22, are pivoted to a support frame 24 at 26, 28 respectively. This disposition of members 20, 22 and their attachments to the upright member 14 and support frame 24 forms a conventional parallel motion linkage. With this arrangement the orientation of support frame 24 is held constant as members 20, 22 pivot about the upright member 14 to raise the support frame. It should be appreciated that the arrangement of parallel members 20, 22 and upright member 14 is duplicated at each side of base 12. For purposes of simplifying the description only one upright member and one pair of parallel members is shown.

The means for providing the motive force for moving the parallelogram linkage can be any conventional electric, pneumatic or hydraulic motor 30. This motor exerts its driving force between base 12 and one or another of the parallel member 20, 22. In the embodiment shown, motor 30 is an electric motor pivoted to base 12. This motor turns a drive screw 32 which moves a slave nut 34. The slave nut is pivoted to a yoke 36. This yoke is fixed to a channel member 38 which in turn is fixed and extends between parallelogram member 20 and its companion member (not shown) on the other side of base 12. In this respect channel member 38 has its ends connected, as by welding, to a flange 40 depending from each parallelogram member 20.

Support frame 24 carries a pair of spaced bearings 42 at each side of the frame, one such pair being shown. Slidably mounted with respect to each pair of bearings is a sliding rod 44 which carries a seat plate (not shown). It should be appreciated that while not shown in the figures the patient supporting portions of the dental chair, such as the seat, backrest and footrest are mounted to a seat plate which is carried by the rods 44. One of the rods 44 and one pair of spaced bearings are shown in the figures at one side of the chair, an equivalent rod and spaced bearings (not shown) being positioned at the opposite side of the chair. With this arrangement the seat plate can be connected to the forward and rearward ends of each rod so as to span the spaced bearings.

Attached to the forward end 46 of rod 44 is a bracket 48 which extends down in front of support frame 24. Pivoted to the lower end 50 of the bracket is one end 52 of a drive link 54. Drive link 54 extends generally along parallelogram member 20 beneath support frame 24. The drive link then makes a dog leg bend so that its other end 56 extends slightly below the other parallelogram member 22 when the support frame 24 is in the low position.

This end 56 of the drive link is pivoted to a connecting link 58 which is rigidly fixed to channel 38.

Figure 2:
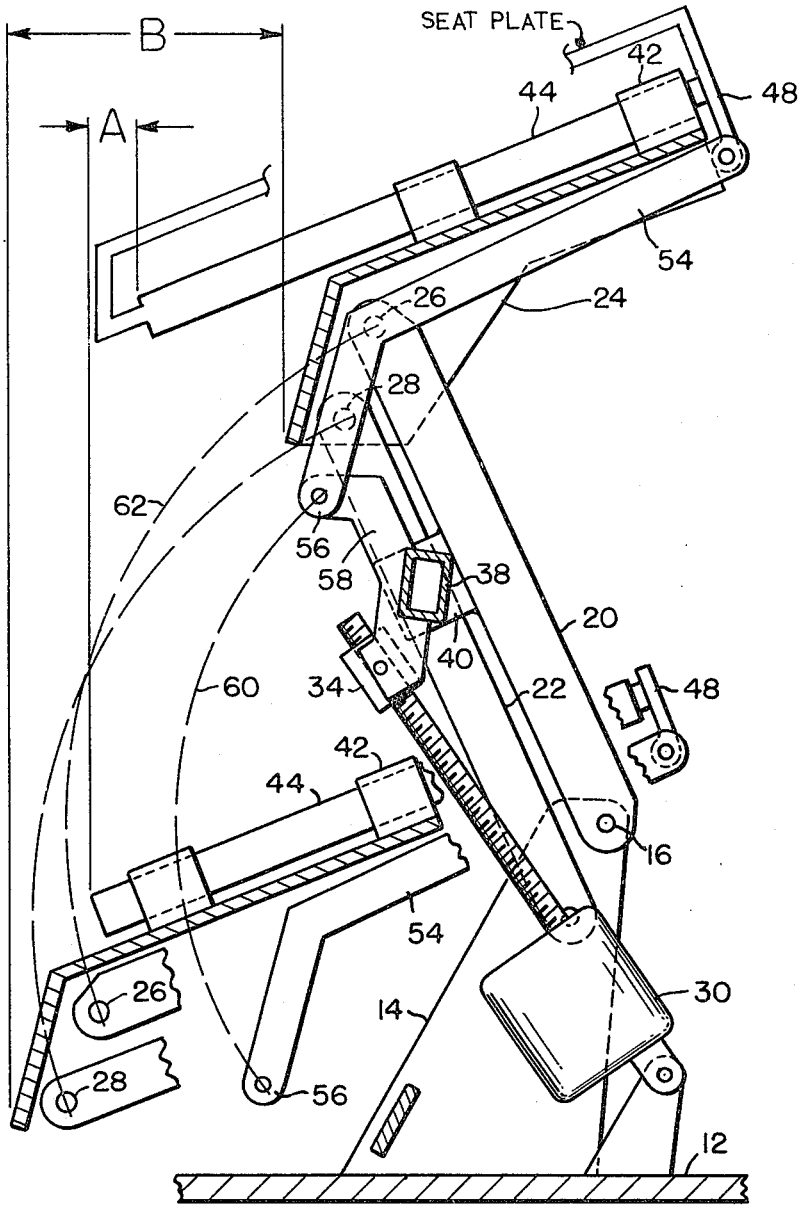
FIG. 2 is a view similar to FIG. 1 on a smaller scale showing the lift mechanism at its highest position and illustrating the path of travel of the lift as it moves between a high and a low position.

In the situation as shown in FIG. 2, motor 30 has been operated to elevate support frame 24 to its highest point. When elevating support frame 24, parallelogram members 20, 22 are rotated about upright portion 14 of the base. Such rotation imparts both a vertical and a horizontal component of motion to the support frame. When lifting the dental chair, this horizontal component is to the right, or forward as shown in the figures. However, as set out hereinbelow, the construction and operation of drive link 54 is such that it provides a horizontal component of motion to sliding rod 44 which is opposite to the horizontal component produced by parallelogram members 20, 22. Thus, as parallelogram members 20, 22 move the support frame 24 upward and forward, to the position shown in FIG. 2, drive link 54 acts to move rod 44 (and the seat it carries) to the rear. The net result is that the patient supporting structure connected to rod 44 does not translate horizontally in the same manner as the support frame, so that the patient supporting structure on rod 44 moves vertically in nearly a straight line.

FIG. 2 shows the paths which are traversed by the various pivot points as the lift mechanism moves between a high and a low position. In the low position, it is seen that end 56 of drive link 54 is forward or to the right of the parallelogram pivots 26, 28. However, FIG. 2 shows that when the lift has reached its highest position, end 56 of the driving link 54 has moved to a position to the left or rearward of the pivots 26, 28. This is because the radius of the curved path of travel 60 of link end 56 (as measured from pivot point 16) is shorter than the radius of the curved path of travel 62 by pivot 26 (as also measured from pivot 16). This allows link end 56 to trail or fall behind pivots 26, 28 as parallelogram members 20, 22 move toward the vertical. Since depending bracket 48 is fixed to the other end of driving link 54, this bracket must follow the motion of the link to push sliding rod 44 rearward, or to the left, as shown in the figures, thus, offsetting, in part, the forward horizontal component of motion induced by operation of parallelogram members 20, 22.

The net result is that as support frame 24 is elevated to its highest point, the horizontal movement of rod 44 and therefore, the dental chair (not shown) connected to the rod moves forward by the distance shown at A whereas the distance shown at B is the horizontal distance traveled by the support frame 24 and this also would be the horizontal distance traveled by the seat if it were connected directly to support frame 24. Conversely, as the support frame 24 is lowered, it moves rearward, or to the left as shown in the figures. Drive link 54, being shorter than the parallel members 20, 24 moves forward, or to the right relative to the parallel members. Accordingly, the net result is that sliding rod 44 slides forward with respect to support frame 24.

Thus, it should be appreciated that the present invention provides a parallelogram lift mechanism for dental chairs or the like which lifts the dental chair in a substantially straight vertical path. The present invention has the advantages provided by the simple construction and operation of a parallelogram mechanism while eliminating the undesirable horizontal component of motion inherent in the operation of such a mechanism.

I claim:

1. In a dental chair having a fixed base, a support frame for carrying the seat of the chair and a parallel motion linkage including upper and lower parallel members each pivotally connected at their ends to the base and the support frame respectively and motor means operatively connected to the parallel motion linkage for moving the support frame about the base between a low and a high position wherein the frame moves forward with respect to the base as the frame goes to the high position and wherein the frame moves rearward with respect to the base as the frame goes to the low position, the improvement comprising:

(a) spaced front and rear bearings on said support frame;

(b) a rod for carrying the seat of the chair, said rod extending slidably through said bearings for movement relative to said support frame;

(c) drive means for moving said rod relative to said support frame in a forward or rearward direction counter to the motion of said support frame, said drive means including an elongated drive link having a first end pivotally connected to the forward end of said rod and having its second end pivotally connected to one member of said parallel motion linkage intermediate the ends thereof.

2. A dental chair as in claim 1 wherein said one member is the upper member of said parallel motion linkage.

3. A dental chair as in claim 2 including:

(a) a channel connected to and depending from said upper parallel member; and (b) a connecting link having one end rigidly fixed to said channel said connecting link being pivotally connected to said drive link to provide the pivotal connection of the second end of said drive link to said upper member.

4. A dental chair as in claim 3 wherein said drive link has a dog leg bend to position the second end of said drive link below said upper parallel member when the dental chair is at a low position.

5. A dental chair as in claim 1 including:

(a) a bracket fixed to the forward end of said rod and extending downward from said rod to a point below said support frame;

(b) said drive link having its first end pivotally connected to said bracket and therefore to the forward end of said rod, said drive link extending rearward from said bracket along and below said support frame.

6. A dental chair as in claim 5 wherein:

(a) said drive link has a dog leg bend intermediate its ends which locates the second end of said drive link below said one member of said parallel motion linkage; and (b) a connecting link rigidly fixed to said one member and pivotally connected to the second end of said drive link to provide the pivotal connection of said drive link second end to said one member.

* * * * *